US010875760B2

(12) United States Patent
Suntup

(10) Patent No.: US 10,875,760 B2
(45) Date of Patent: Dec. 29, 2020

(54) METHOD FOR DELIVERING HEATING OIL TO CUSTOMERS OF FUEL OIL DEALERS

(71) Applicant: Jeffrey Hale Suntup, New London, CT (US)

(72) Inventor: Jeffrey Hale Suntup, New London, CT (US)

( * ) Notice: Subject to any disclaimer, the term of this patent is extended or adjusted under 35 U.S.C. 154(b) by 0 days.

(21) Appl. No.: 15/264,137

(22) Filed: Sep. 13, 2016

(65) Prior Publication Data

US 2017/0029264 A1 Feb. 2, 2017

Related U.S. Application Data

(63) Continuation of application No. 13/561,041, filed on Jul. 29, 2012.

(51) Int. Cl.
*B67D 7/08* (2010.01)
*B67D 7/62* (2010.01)
(Continued)

(52) U.S. Cl.
CPC ..... *B67D 7/08* (2013.01); *B67D 7/40* (2013.01); *B67D 7/62* (2013.01); *B67D 7/84* (2013.01);
(Continued)

(58) Field of Classification Search
CPC ... B67D 7/08; B67D 7/40; B67D 7/62; B67D 7/84; B67D 7/04; B67D 7/044;
(Continued)

(56) References Cited

U.S. PATENT DOCUMENTS 3,250,437 A * 5/1966 Smith ..... B60P 3/2215 222/609
3,580,420 A * 5/1971 Kennedy ..... B08B 9/0321 222/1

(Continued)

OTHER PUBLICATIONS

Internet Archives: Wayback Machine, "John Ellsworth Company: 100 Gallon Transfer Tank by Better Built", Jan. 26, 2011, 1 page.*

(Continued)

*Primary Examiner* — Paul R Durand
*Assistant Examiner* — Andrew P Bainbridge
(74) *Attorney, Agent, or Firm* — C Nessler

(57) ABSTRACT

A method for delivering heating oil to homes and commercial establishments comprises a two-mode combination of (a) using a conventional large-tank delivery truck and (b) using a portable, self-contained apparatus which is carried on a lighter weight truck as cargo. The portable apparatus comprises a tank having just under 119 gallons capacity, a pump for flowing oil through a meter subsystem which measures the quantity of oil, to a hose; all mounted on a skid for portability. The apparatus is capable of dispensing oil quantities of 1, 5, or 25 gallons while meeting regulators' weights and measures approval requirements. When the small tank is filled with heating oil, preferred apparatus weighs less than 1500 pounds and is removably carried on the bed of an un-placarded truck (one that does not have to meet hazardous material requirements), and that may be driven by a driver having an ordinary driver's license, compared to the requirements and associated costs attending the conventional truck.

4 Claims, 3 Drawing Sheets

(51) Int. Cl.

| | |
|---|---|
| ***B67D 7/84*** | (2010.01) |
| ***B67D 7/40*** | (2010.01) |
| ***F23C 7/00*** | (2006.01) |
| ***F04B 23/02*** | (2006.01) |
| ***F04B 13/00*** | (2006.01) |
| ***F04B 49/10*** | (2006.01) |
| *B67D 7/04* | (2010.01) |
| *B67D 7/24* | (2010.01) |

(52) U.S. Cl.
CPC ..... *F04B 13/00* (2013.01); *F04B 23/025* (2013.01); *F04B 49/106* (2013.01); *F23C 7/008* (2013.01); *B67D 7/04* (2013.01); *B67D 7/243* (2013.01); *B67D 7/845* (2013.01)

(58) Field of Classification Search
CPC ..... B67D 7/0442; B67D 7/0476; B67D 7/24; B67D 7/243; B67D 7/845; F04B 13/00; F04B 23/025; F04B 49/106; F23C 7/008
USPC ..... 222/71–73, 538–539, 608–610, 626, 1; 141/231; 224/42.32
See application file for complete search history.

(56) References Cited

U.S. PATENT DOCUMENTS 3,810,487 A * 5/1974 Cable ..... B60P 3/2265 137/351
3,894,811 A * 7/1975 Bergey ..... F04B 49/20 417/34
3,907,168 A * 9/1975 Davis ..... B60P 3/14 222/63
3,926,230 A * 12/1975 Stary ..... B67D 7/0476 141/45
4,131,214 A * 12/1978 Rogers ..... B60P 3/225 222/1
4,313,168 A * 1/1982 Stephens ..... G07F 13/025 705/413
4,345,146 A * 8/1982 Story ..... B67D 7/08 235/381
4,475,665 A * 10/1984 Norton ..... B67D 7/62 222/14
4,911,330 A * 3/1990 Vlaanderen ..... B60P 3/224 222/132
5,186,324 A * 2/1993 Brandon, Jr. ..... B60P 1/162 137/592
5,230,374 A * 7/1993 Dawson ..... B62B 1/264 141/18
5,292,012 A * 3/1994 Davis ..... B60P 3/2205 211/85.18
5,573,066 A * 11/1996 Vaillancourt ..... B67D 7/84 169/49
5,706,273 A * 1/1998 Guerreri ..... B67D 7/08 700/283
5,947,148 A * 9/1999 DeVito ..... B65H 75/425 137/355.2
5,975,162 A * 11/1999 Link, Jr. ..... F17C 13/002 141/192
6,766,966 B2 * 7/2004 You ..... B60S 3/044 222/175
6,871,540 B2 * 3/2005 Barlian ..... B67D 7/08 73/290 R
7,159,794 B2 * 1/2007 McIntyre ..... A47L 13/51 222/538
7,303,362 B2 * 12/2007 Dunlop ..... B60P 1/00 222/608
7,549,847 B1 * 6/2009 McClatchey ..... F04B 9/02 417/15
7,856,998 B2 * 12/2010 Bauer ..... B60P 3/14 137/15.16
8,245,889 B1 * 8/2012 Starns ..... B67D 7/0238 222/399
9,440,843 B2 * 9/2016 Polzin ..... B67D 7/845
10,099,915 B2 * 10/2018 Kittoe ..... B67D 7/3209
10,373,238 B2 * 8/2019 Hill ..... B60L 53/80
2001/0042574 A1 * 11/2001 Reynolds ..... B60P 3/2245 141/231
2006/0207681 A1 * 9/2006 Purington ..... F04B 43/073 141/231
2006/0272740 A1 * 12/2006 Poulter ..... B60P 3/2245 141/231
2009/0045216 A1 * 2/2009 Mamaghani ..... B67D 7/00 222/1
2010/0101659 A1 * 4/2010 Trattner ..... B67D 7/04 137/87.03
2010/0200107 A1 * 8/2010 Weathers ..... B67D 7/02 141/4
2011/0036428 A1 * 2/2011 Lynn ..... B67D 7/60 137/565.17
2016/0348897 A1 * 12/2016 Suntup ..... F04B 13/00
2017/0029264 A1 * 2/2017 Suntup ..... F23C 7/008
2018/0285847 A1 * 10/2018 Pier ..... B67D 7/40
2019/0295194 A1 * 9/2019 Kittoe ..... G06Q 20/202

OTHER PUBLICATIONS

Internet Archives: Wayback Machine, "John Ellsworth Company: 110 Gallon DOT Refuleing Transfer Tank", Dec. 3, 2011, 1 page.*
Internet Archives: Wayback Machine, "www.transcube.us.com: Transcube with Fork Lift Tines, 132 Gallon Transfer Tank", Apr. 29, 2011, 1 page.*
PLUS Search requested by Andrew Bainbridge and delivered on Oct. 19, 2020 by USPTO support staff, 50 entries (Year: 2020).*
STIC Search Results requested by Andrew Bainbridge and delivered on Oct. 31, 2020 by USPTO support staff, 5 entries (Year: 2020).*

* cited by examiner

METHOD FOR DELIVERING HEATING OIL TO CUSTOMERS OF FUEL OIL DEALERS

This application is a continuation of application Ser. No. 13/561,041, filed Jul. 29, 2012, and claims benefit of provisional patent application No. 61/547,412, filed Oct. 14, 2011.

TECHNICAL FIELD

The present invention relates to methods for delivering domestic heating oil to customers of fuel oil dealers, in particular. using two different kinds of delivery trucks, one of which comprises an oil tank that is treated as cargo; the other not.

BACKGROUND

Homes which are heated by burning oil, as are common in the northeastern United States, typically have building code-compliant storage tanks which hold approximately 275 to 330 gallons of heating oil. Heating oil is most often delivered to the home by means of local-delivery tank trucks which hold about 2,800-5,000 gallons of heating oil and have a gross vehicle weight in the range of 32,000 to 60,000 pounds. Since large heating oil delivery trucks weigh more than 26,001 pounds, they are required to have air brakes. At the customer site, heating oil is pumped from the tank of the truck through a hose pulled from a reel on the truck and to a nozzle at the end of the hose which is inserted into the fill pipe of the customer storage tank. The oil pump is typically driven by the truck engine by means of a power take-off and drive shaft. Characteristically oil flows at a high rate through substantial diameter piping and hoses.

Generally, the transfer of ownership from one party to the other, for instance, from a licensed heating oil dealer to a home or business owner, is referred to as "custody transfer." The term custody transfer implicates various requirements that mandate meeting industry and legal/regulatory standards. In many states, consumer protection and/or sales tax laws impose standards on the accuracy and recordation of heating oil transfers. As applied to the process of delivering heating oil to a customer, custody transfer means that the heating oil quantity must be metered and recorded accurately, regardless of variables such as flow rate, temperature and viscosity. A printed record, sometimes called a receipt or a ticket, should be produced showing the quantity delivered for the customer's and the dealer's records and to meet government requirements.

The components of a familiar large local-delivery heating oil tank truck which include a high flow capacity metering system that implements custody transfer are commonly required to have a Certificate of Conformance pursuant to the National Type Evaluation Program (NTEP certification) of the National Conference on Weights and Measures, Lincoln, Nebr. A Certificate may be issued based on an authorized tester's determination that the system complies with the standards of the United States Department of Commerce, namely, with requirements set forth in National Institutes of Standards and Technology "NIST Handbook 44: Specifications, Tolerances, and Other Technical Requirements for Weighing and Measuring Devices." These requirements are hereafter referred to as the "NTEP certification standard." The NTEP certificate number is usually engraved on an approved system which is used in commerce. The metering system of a truck must also pass the accuracy-of-flow standard and other requirements of state regulators.

One way of expressing that a system is compliant with laws and regulations applicable to accurate measurement of residential heating oil deliveries is to say that the system is "weights and measures approved."

A commercial objective for heating oil dealers is to maximize the utilization of a tank truck, particularly since they presently can cost from $120,000 to $250,000 each. To minimize the time a truck consumes in pumping oil into the customer storage tank, the pumps of tank trucks typically have high flow rates, for example 40-110 gallons per minute. A typical quantity delivered by tank truck may be in the 100-300 gallon range.

Another objective is to minimize the number of times which a driver and truck have to return to the dealer site or an oil terminal, to refill the tank truck. This leads to a desire to have a truck with as large tank capacity as possible. But using a typical large truck can present a problem when a driveway, roadway, or bridge has a load limit below that of the weight of even a partially loaded local-delivery heating oil tank truck. A mosaic of federal, state, and local laws and regulations must be complied with in owning, storing and operating a typical heating oil tank truck. They include U.S. Federal Hazardous Materials Regulations relating to transport of hazardous and combustible liquids and laws and regulations aimed at protecting the environment, avoiding fire risk, avoiding terrorist attacks, etc. Periodic vehicle checks are mandated; a driver must make an inspection of the truck at the start of the first daily use, tire inflation must be systematically checked, the truck must carry a fire extinguisher, etc. State motor vehicle authorities, federal department of transportation officers, local/state police, and homeland security officials are known to make in-yard and on-the-road inspections. Fire marshals and insurers may impose other requirements. A truck which carries hazardous materials including heating oils is required by federal law to display specific kinds of placards on the front, rear and both sides, indicating the class of material which is being carried. In the common parlance, when one says that a motor vehicle must be "placarded," that communicates that the vehicle must meet certain federal standards which include making the required placard displays.

The driver of a heating oil tank truck driver must be a professional: First, the driver must have a commercial driver license (CDL). That requires passing certain background checks, medical tests, and special driving tests. The driver must meet higher performance standards than regular drivers, both while driving a heating oil tank truck and while driving other ordinary vehicles, including personal vehicles. Time "behind the wheel" is regulated. There are random drug tests. In addition, the driver of a local-delivery heating oil tank truck must have endorsements to his or her CDL license, including those for carrying hazardous materials, for operating a tank truck, and for operating a vehicle equipped with air brakes. Recent anti-terrorism measures require a Transport Worker Identification Card (TWIC) if the tank truck is driven into an oil terminal for a re-fill or onto certain other sites that are deemed important to U.S. homeland security. Large local-delivery heating oil tank trucks tend to have high centers of gravity compared to non-tank trucks, and the contents might surge or slosh around and induce instability; thus special driver diligence is required.

The requirement for a CDL with requisite endorsements limits the number of people who are available to be drivers of local-delivery heating oil tank trucks. Understandably, persons who meet the requirements can demand higher wages than can lesser-licensed drivers.

In general, large local delivery heating oil tank trucks are costly to operate. Since they weigh a lot, they get a low fuel mileage, commonly in single-digit miles per gallon. Sending a large heating oil tank truck and qualified professional driver to a customer's site is costly in terms of labor and operating costs; and the dollar mark up on a small quantity of heating oil can easily be insufficient to cover the costs.

With the greatly increased price of heating oil in recent years, presently $3-4 per gallon in northeastern U.S., there has been a tendency for less affluent homeowners to decline delivery of 100 or more gallons at a time, because they wish to avoid the dollar outlay. Instead, a number of consumers seek delivery of smaller quantities, even in the range of 1 to 5 to 25 gallons at a time. Heating oil dealers encounter other situations when small quantities could be appropriate. For example, if a consumer runs out of heating oil at an inopportune time, such as in the middle of the night, mobilizing a qualified driver and tank truck, and paying the driver for a requisite minimum number of hours can be costly. Yet, all the customer needs is a few gallons, to last until the next day or two when a driver can make a larger delivery as part of his regular tank truck delivery route.

Dealers who operate conventional large local-delivery heating oil tank trucks are typically not capable of meeting needs for small quantity deliveries of the kind just mentioned: They cannot easily dispense and/or accurately meter small quantities of oil, particularly in the quantities such as 1, 5, 10 or less than 25 gallons while using a large weights and measures approved tank truck. While some large tank trucks may be able to dispense such a small quantity of heating oil, such small a quantity cannot be accurately measured in conformance with NTEP certification standards, in context that the pump and metering system are configured for handling large quantities and high flow rates, as mentioned above. There is another problem which tank truck-using dealers face: It relates to bad weather conditions which make it difficult for a tank truck to reach certain sites, for instance, when there are snow and ice conditions and the terrain is steep. Typical large local-delivery heating oil tank trucks have rear wheel drive only and are not allowed to be fitted with tire chains (because of the risk of a loose chain penetrating the oil tank). Thus, there can be times when it is physically very difficult to service a customer. Anecdotally, some dealers in mountainous and wintery areas have used smaller and lighter custom designed tank trucks, including four-wheel drive trucks, when they have a number of difficult customer sites; alternately, they have transported oil to the customer in common 55 gallon drums and the like.

Diesel fuel meets different technical requirements than does heating oil, as explained further below in the Description. Diesel fuel is used in internal combustion engines. Most diesel oil for consumers is sold in roadside service stations. To deliver diesel oil to construction and agricultural vehicles and the like which are in the field, it has been a familiar practice to mount small diesel oil tanks, often a 55 gallon drum, on pickup trucks and the like and to drive to the vehicle location. While typically there is only a pump system for transfer of the diesel fuel from the tank on the truck to the tank of the vehicle, a metering or measuring system of some sort may be used. This kind of distribution mode typically does not involve custody transfer from a dealer to a customer of the kind that triggers regulatory requirements; and any requirements would not be of the specialized nature relating to custody transfer of heating oil delivery to residential and commercial buildings.

Diverse manufacturers have commercially offered portable wheeled and skid-mounted systems for transporting and/or pumping oils or other liquids, beyond heating oil and diesel fuel. However, many of the prior art ways of carrying and delivering non-heating oil products cannot be used by licensed heating oil dealers because those ways do not and cannot meet the particular and specialized regulations and standards mentioned above. Thus, there is a need for a better and more flexible way for accurately delivering small quantities of heating oil to users in an economic way, where the heating oil is transported and metered in a manner acceptable to regulatory and tax authorities and standards setting organizations.

SUMMARY

An objective of the invention is to provide a means for delivering small quantities of heating oil to consumers in a manner which comports with regulatory and tax requirements and which is economically more advantageous than using a common large heating oil tank truck. Another objective is to deliver small quantities of heating oil to consumers in way which avoids having to have a CDL licensed driver and avoids the costs of meeting standards which large local-delivery heating oil tank trucks must meet. A further objective is to have a self contained and portable heating oil transfer apparatus for dispensing small quantities.

In accord with an embodiment of the method of the present invention, a dealer can deliver home heating oil to a customer using two different modes: First, to make typical deliveries of 119 or more gallons at a time, the dealer uses a typical large local-delivery heating oil tank truck, one having a capacity of 1,000 gallons or more and driven by a CDL licensed driver meeting the other requisites. Second, the same customer is at other times delivered smaller quantities of heating oil, such as in the 1 to 25 gallon range, and up to almost 119 gallons, by means of the skid mounted apparatus of the present invention carried on a less-than-26,001 pound gross vehicle weight rating truck, which truck is driven by a driver who does not have a CDL, or by a driver who lacks one or more of the endorsements required for lawful operation of the large local-delivery heating oil tank truck used for the first mode delivery. The times when the second mode is used to deliver a smaller-than-119 gallon quantity may include situations where the customer is short of funds or for other reason only wants a small quantity of heating oil, when there is a run-out in the middle of the night, or when road conditions are extremely adverse, etc.

In accord with an embodiment of the apparatus used in the present method invention, a heating oil delivery apparatus comprises a heating oil tank of about 119 gallons capacity or less; a pump, preferably having a flow rate of about 2-22 gallons per minute; an air and vapor eliminator; a meter subsystem which meets NTEP certification requirements; and a hose or other conduit for discharging heating oil to a customer storage tank or other container. The apparatus embodiment further comprises a skid and the foregoing components are mounted on a skid. Thus the apparatus is portable, so it may be removably mounted on the bed of a pickup truck or other vehicle. The limited tank capacity and portability of the apparatus mean that a vehicle carrying the apparatus as cargo does not have to meet the same regulatory requirements as does a multi-thousand gallon tank truck.

The apparatus of the foregoing embodiment is preferably self-contained and has its own power supply, such as storage batteries which drive a DC motor powered pump. An exemplary apparatus with a filled tank has a weight of no more than 1500 pounds and can be transported along public roads while secured on the bed of a pickup truck or the like which has a gross vehicle weight rating of less than 26,001 pounds, typically 10,000 pounds or less. Operation of such a vehicle requires neither a CDL licensed driver, nor a driver meeting other requirements (license endorsements) which are related to operation of a common 26,001 pound or more heating oil tank truck.

The inventive method enables a dealer to make deliveries of both small and large quantities while being in compliance with motor vehicle laws and regulations and with approved weights and measures procedures, particularly including NTEP certification requirements. And the dealer's operating and labor costs are reduced compared to the costs of a dealer who only uses a common large local-delivery heating oil tank truck to service customers. Furthermore, the invention will permit heating oil deliveries that would otherwise be delayed or less practical or less cost effective.

The foregoing and other objects, features and advantages of the present invention will become more apparent from the following description of preferred embodiments and accompanying drawings.

DESCRIPTION

Figure 1:
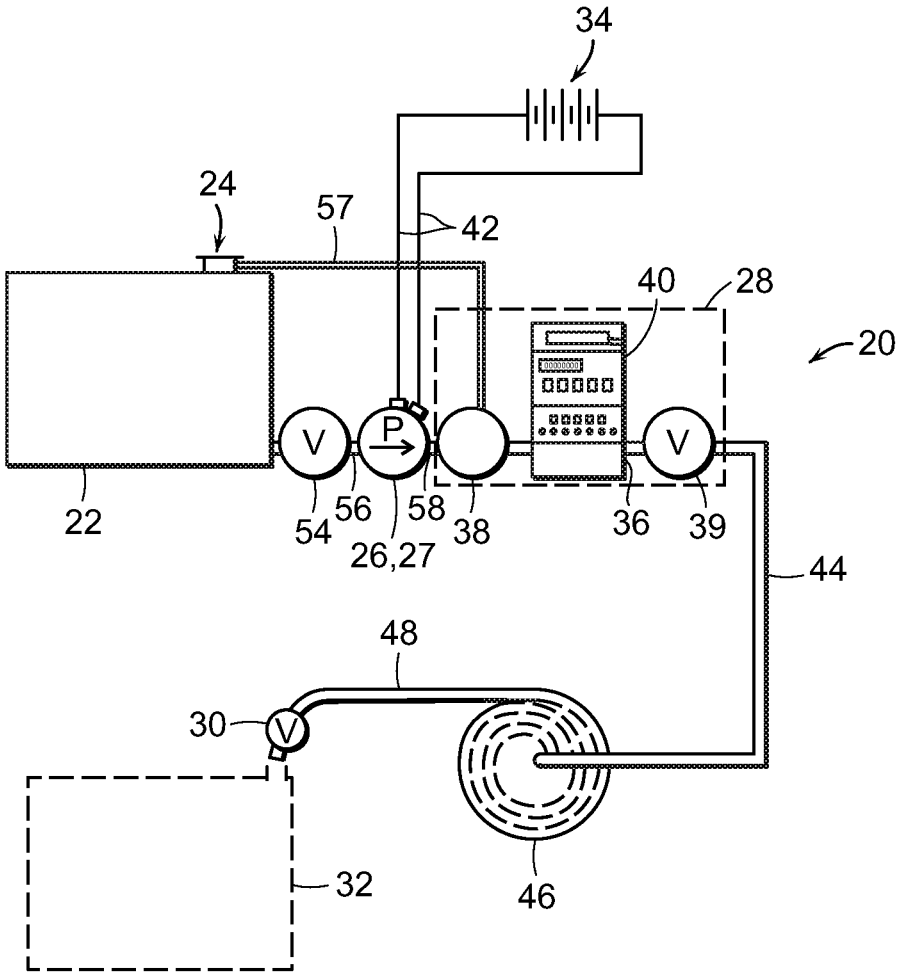
FIG. 1 is a schematic diagram of apparatus of the present invention.

Referring to the Figures, particularly FIG. 1, a preferred invention apparatus 20 is comprised of several elements. A compactly configured storage tank 22 having a hatch or filler port 24 is suited for carrying almost 119 gallons of heating oil. Pump 26 is driven by an integral motor 27, preferably a DC motor powered by electric lines 42 running from battery 34. Pump 26 draws oil from tank 22 through shut-off valve 54 and line 56; oil from the pump flows through line 58 to air and vapor eliminator 38, then through meter 36, then through preset quantity control valve 39. Connected to the meter is register 40 which displays the oil quantity which has been pumped. Register 40 also includes an integral printer for producing a paper receipt or ticket.

The oil flows from the meter subsystem 28 through a pipeline 44 to hose reel 46 and then through hose 48 and nozzle valve 30 and into customer container 32, a tank shown in phantom in FIG. 1. Meter 36 is preferably of the piston-positive displacement type described below. The filler port 22 of tank 24 is preferably a so-called bulkhead fitting, familiar in heating and fuel oil industry. The bulkhead fitting is crafted to prevent the escape of vapors or liquid, but it allows air to enter the tank as heating oil is removed from the tank by the pump.

The meter subsystem comprises the combination of an air and vapor eliminator 38, a flow meter 36, the preset quantity control valve 39, and the data display and printing register 40. Air and vapor removed from the oil is vented through pipe line 57 which runs from the air and vapor eliminator 38 to tank 22. Optionally, as regulations may permit, air and vapor may be passed through a filtering system and vented to atmosphere. Depending on the oil condition and state regulations it may be allowable to omit one or both the air and vapor eliminator 38 and printer.

If delivery of a predetermined quantity of oil is desired, the truck driver programs the meter subsystem for the desired quantity, and mechanisms within the meter subsystem cause the preset control quantity valve 39 to close and stop oil flow when the predetermined quantity has passed through the meter.

Figure 2:
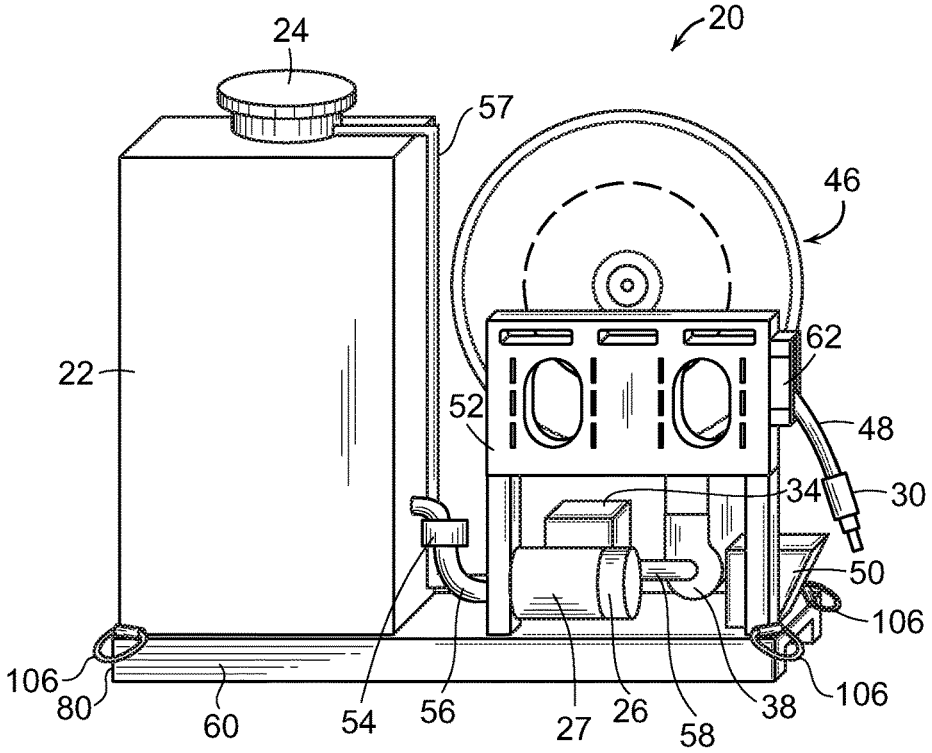
FIG. 2 is a side view of an embodiment of apparatus of the invention, including a skid.
Figure 3:
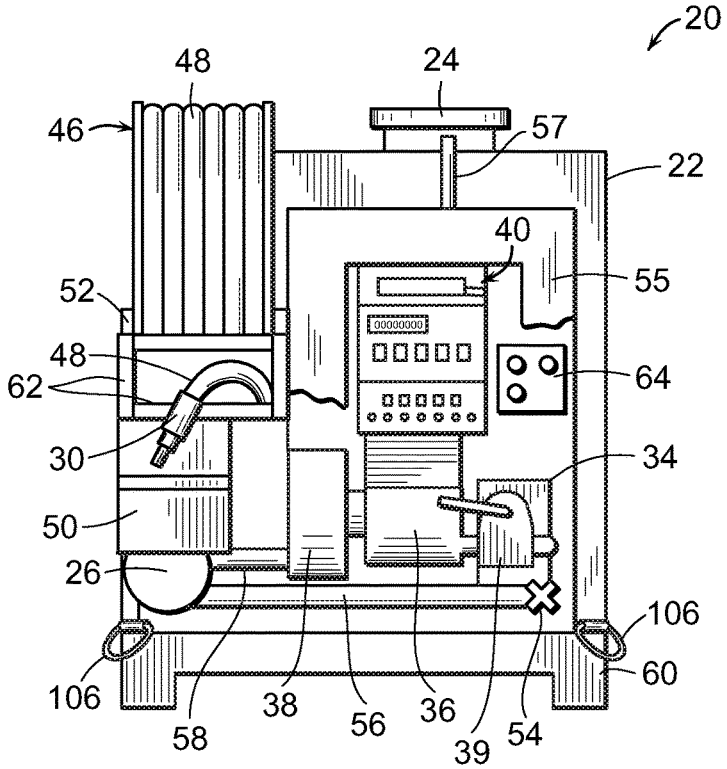
FIG. 3 is an end view of the apparatus in FIG. 2.

As shown in FIG. 2 and FIG. 3 the free end of the hose runs through guide 62 which is of the fairlead roller type. To dispense heating oil, an operator pulls hose from the reel in an amount sufficient to reach a customer container 32. The operator manipulates nozzle valve 30 at the free end of the hose, to flow a desired quantity of oil into container 32, for example, into a customer's heating oil storage tank.

There may be other fittings and devices in the oil flow path of an invention apparatus. Generally stated, the pump is in fluid communication with the tank; the meter subsystem is in fluid communication with the pump, and the hose of other discharge conduit is in fluid communication with the meter subsystem.

Figure 4:
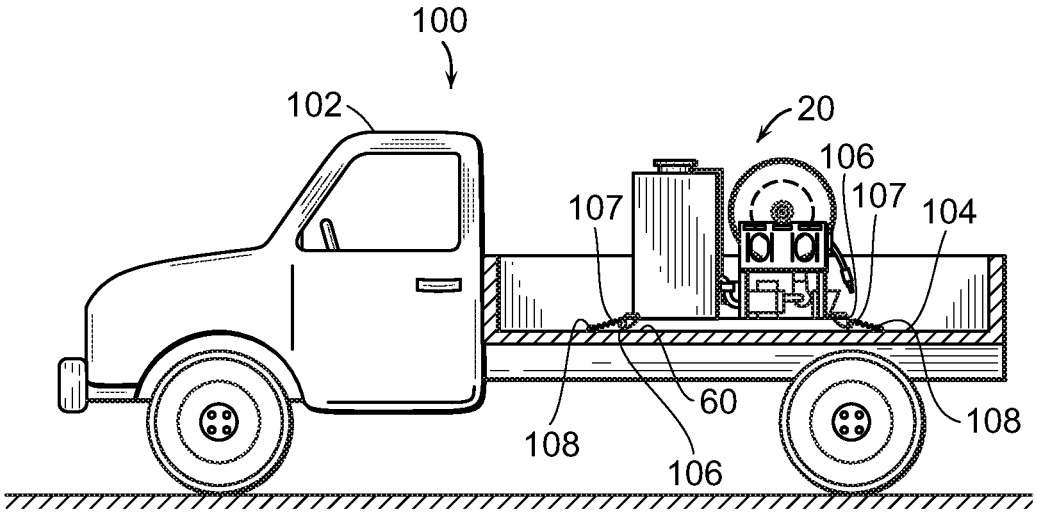
FIG. 4 is a side view of a pickup truck, with a portion of the truck bed cut-away, and the apparatus shown in FIG. 1 and FIG. 2 mounted on the bed.

Referring to FIG. 2 and FIG. 3, apparatus 20 comprises skid 60, so that it can be moved as a portable assembly. For example, as illustrated by FIG. 4 the portable assembly 20 can be set within the bed 104 of a pickup truck 100 having a driver cab 102 near the front end thereof. The tank end of the apparatus is near the cab and the hose reel dispensing end is more distant from the cab and thus nearer to the back end of the truck. The tank end is situated between the front wheels and rear wheels of the pickup truck. Apparatus 20 can be transferred easily from one vehicle to another or to the ground for stationary operation. Portability is an important feature, since if the apparatus is attached to truck 100 or another vehicle in permanent fashion, the vehicle could be designated a heating oil tank truck, thus invoking regulatory requirements. To prevent movement during operation of the truck along a roadway, apparatus 20 is typically secured at four points to the bed 104 of truck 100 by tie downs 107 which connect D-rings 106 at the four corners of skid 60 to fittings 108 on the truck bed. The tie downs may be straps, chains, binders, etc.

Tank 22 is preferably a welded steel rectanguloid and is positioned at the rear end 80 of the skid 60, as shown. Tank 22 may have other shapes. Tank 22, or any substitutional multiplicity of smaller tanks, has a volume capacity of about 119 U.S. gallons, but less than 119 U.S. gallons, to avoid triggering application of laws, regulations and other requirements that attend larger tanks carried by trucks. The tank capacity may be less than 119 gallons, but an about 119 gallon tank is preferred because it minimizes the frequency with which a driver has to refill the tank when making deliveries.

Hose reel 46 is a conventional commercially known unit that is power-assisted by a drive means (not shown) to aid reeling hose 48 back onto the reel when dispensing of heating oil has been completed. A hand-cranked reel may be alternatively used. Hose reel 46 is supported on stanchions 52 that extend upwardly from skid 60. As shown, the hose reel is spaced apart from the tank and near the skid front end, and it is oriented for unreeling hose in the lengthwise direction and from the rear of a pickup truck. See FIG. 2 and FIG. 4. The hose reel is configured to rotate in a vertical lengthwise plane. In the generality of the invention, there is a dispensing conduit in fluid communication with the meter subsystem and that conduit may comprise, as an alternative, a simple length of hose or pipe without any hose reel.

With reference to FIG. 3, control system housing 55 is also mounted on skid 60; it is shown with its bottom portion cut away. Housing 55 protects portions of the meter subsystem and contains control panel 64. It preferably has a lockable door (not shown). Control panel 64 comprises electric switches and protective devices for controlling operation of the pump, for energizing other electric parts of the system and a light, and so forth. A conveniently accessible extension of the handle of shut-off valve 54 runs to the rear of the apparatus where it is just above the skid top and underneath the meter subsystem.

Pump 26 which preferably has an integral direct current motor 27, is chosen for a flow capacity in the range of 2-22 gallons per minute (GPM). When used with an alternative AC motor the flow rate may be 2-29 GPM.

The combination of pump 26 and meter subsystem 28 are capable of accurately transferring and measuring small quantities of heating oil. For example, between 1 and 25 gallons can be transferred and accurately controlled and measured, and a ticket or other permanent record can be produced showing the quantity dispensed to the nearest one-tenth of a gallon. The comparative low flow rate of the pump of the invention apparatus makes it suited for filling small containers, such as a 5 gallon container. That contrasts with the large flow rate pumps characteristic of many large local-delivery heating oil tank trucks mentioned in the Background, for example one that is capable of flowing 40-110 GPM. Not only are those pumps poorly suited for pumping of small quantities, the meter subsystems of such tank trucks do not provide accurate metering of less than 25 gallon quantities.

Apparatus 20 preferably includes skid 60 which is, for example, about a 40 inch by 48 inch rectangle of fabricated steel; it has a footprint small enough to fit on the bed of a common pickup truck. The term "skid" shall not be limiting and shall be construed as embracing any structure which functions as a base sufficient to carry the apparatus components and enable them to be moved as an integral unit while functionally interconnected. The tank, pump, and piping, control housing and skid are preferably constructed prevalently of iron alloy materials; alternative materials including aluminum and copper alloys may be used.

Apparatus 20 is constructed in a manner which economizes material and weight. Thus, when tank 22 is empty, an exemplary apparatus 20 which includes one or two storage batteries 34 may weigh about 500-600 pounds. When tank 22 is substantially filled (i.e., nearly 100% filled) with just under 119 gallons of heating oil, which weighs about 840-880 pounds (depending on oil density, which may vary between 7.05 and 7.4 pounds per gallon, and which typically is about 7.2 pounds per gallon), the total weight of the heating oil-filled preferred apparatus is no more than 1,500 pounds, and thus within the capacity of a common commercial 1,500 pound load rating pickup truck or van (familiarly called a "three-quarter ton motor vehicle"). By simple calculation, when such an oil-filled apparatus weighs 1,500 pounds or less, the tank end the apparatus weighs at least about 56 percent—or more than half—of the total apparatus weight.

In an alternative embodiment, tank 22 has a capacity substantially less than 119 gallons, for example, about 70 gallons, and the total weight of the apparatus with a tank filled with oil is about 1,000 pounds, which is within the load capacity of a 1,000 pound load rating truck (familiarly called a "half-ton motor vehicle").

As is well-known, familiar half-ton and three quarter-ton capacity pickup trucks and vans typically have a gross vehicle weight rating of less than 10,000 pounds. That is well below the 26,001 pound threshold weight which requires a CDL and therefore a driver of a vehicle carrying the invention apparatus need only have a regular driver's license. No driver's license endorsements related to driving a large heating oil tank truck are required for such pickup trucks and vans when they are carrying the invention apparatus as removable cargo. And the vehicle carrying the invention apparatus does not have to be placarded, or to have a fire extinguisher, or to be otherwise treated like an ordinary large heating oil tank truck.

Alternatively, a trailer towed by a truck or automobile may be used to carry the invention apparatus. In further alternatives, apparatus 20 or the like may be carried on a boat, barge, sled, airplane, helicopter, etc. In a still further alternative, the apparatus may be used in a stationary mode.

In an alternate embodiment of the invention, an electrical motor driven pump 26 may be powered by other than storage batteries. For example, the pump may be powered by direct current electric system of the truck or other motor vehicle which is used to transport the apparatus, separately or in combination with a storage battery 34. A solar panel may also be used to recharge the battery. A fuel cell or an internal combustion engine powered generator may be used. In another alternative, AC power drawn from a private or public utility alternating current system may be used. In the generality of embodiments of the invention, the apparatus electric power source may be selected from the group comprising: an electric storage device mounted on the skid or separated from the skid, an electric generating device mounted on the skid or separated from the skid, a DC electric system of a motor vehicle, and an AC power system, or combinations of the foregoing.

In the generality of the invention, the meter subsystem includes means for acquiring and recording the quantity of heating oil delivered in weights and measures approved fashion, including in a way which meets the NTEP certification standard. A preferred and currently conventional way of providing a permanent record of an oil delivery is by means of a printer which produces a hard paper copy. In the scope of the claimed invention any reference to printing or printing a ticket shall embrace other means for outputting and recording data about the heating oil quantity delivered, including transmitting by wire or wirelessly information to a local or remote electronic storage or memory device.

As used herein, "residential storage tank" refers to a tank, typically of 250 to 330 gallons capacity, which is building-code approved for use inside or outside a residential dwelling. The term "residential" should not be considered limiting, since conventionally, the same name is applied to such kind of tank when it is used in a commercial building.

The invention apparatus as described is particularly designed and constructed for handling home heating oil (HHO), often also called No. 2 heating oil, and delivering it for heating purposes at residential, commercial, and other buildings. HHO conforms to ASTM standard D396 (ASTM International) and is described more particularly below. As indicated in the Background, the distribution and sale of HHO is particularly regulated, in distinction to how other oil products, including diesel engine fuel oil, may be regulated.

An exemplary embodiment of the present invention has met the NTEP certification standard mentioned in the Background; namely, it will comply with the National Institutes of Standards and Technology requirements set forth in "NIST Handbook 44: Specifications, Tolerances, and Other Technical Requirements for Weighing and Measuring Devices" and will be subject to a Certificate of Conformance pursuant to the National Type Evaluation Program (NTEP certification) of the National Conference on Weights and Measures, Lincoln, Nebr. When the exemplary apparatus flowed oil at rates in the range of 2 to 24 GPM (for DC power supply) and 2-29 GPM (for AC power supply), it was in conformance with accuracy class 0.5*, as set forth in Handbook 44. That included an acceptance tolerance of 0.3 percent for certain heating oil quantities in amounts of 50 gallons or less. An exemplary apparatus 20 was issued a National Type Evaluation Program Certificate of Conformance (No. 11-112) by the National Conference on Weights and Measures and that is marked on commercial embodiments of the apparatus.

Thus, a commercial embodiment of the invention apparatus meets heating oil dealer needs by being weights and measures approved; and since the tank capacity is less than 119 gallons, and since the apparatus is skid-mounted cargo when on a pickup truck or the like, there is no requirement to display placards and meet various other costly heating oil tank truck related standards mentioned above.

An exemplary meter subsystem comprises a Murray brand 1½ inch pipe diameter size petroleum meter Model TMS 682, having an air and vapor eliminator accessory, a strainer, a display register, a ticket printer and a presettable volume control valve (Murray Equipment Inc., Fort Wayne, Ind.). The presettable volume control valve enables a delivery man to input a desired quantity of fuel, e.g. 20 gallons, and the presettable control valve will automatically close and stop the flow of heating oil when that quantity has flowed through the meter. Other commercial meter subsystem units or other combinations of devices may be used to carry out the functions of meter subsystem provided the resultant combination meets NTEP certification standards.

An exemplary pump 26 is a Model 489G-95, sub-code 1011 pump (American Machine Tool. Co., Inc. Royersford, Pa.). Other commercial pumps of comparable function may be used.

The present invention includes a new and different way of delivering liquid petroleum heating oil to residential and commercial customers. The invention enables a dealer to periodically deliver to a customer a small quantity of heating oil, such as 1, 5, 25 gallons, and up to almost 119 gallons, in an economic manner, while meeting regulatory requirements with respect to metering and ticketing, and while conforming with motor vehicle laws and regulations. That compares with using the kind of large local-delivery heating oil tank truck which has a capacity of more than 1,000 gallons, typically 2,800-5,000 gallons, as described in the Background, and which has a pump and meter subsystem that are geared toward delivering 25 gallons or more in a high flow rate manner, which truck is not suited for delivering less-than-25 gallon quantities.

The method of the present invention comprises providing an apparatus for pumping and metering and ticketing home heating oil, which apparatus complies with the NTEP certification standard. The apparatus also comprises a heating oil tank having a capacity of about 119 U.S. gallons or less. The method further includes: transporting the apparatus as removable cargo on a motor vehicle having a gross vehicle weight of less than 26,001 pounds to the point of dispensing heating oil; flowing heating oil through the apparatus by means of an electric powered pump at a rate of 2 to 29 GPM for a total delivery quantity of between 1 and 25 gallons, alternately up to just under 119 gallons; and preferably delivering said quantity of heating oil to a customer's heating oil storage tank, such as are commonly associated with a dwelling, commercial building or other building, where the tank has a capacity of more than 250 gallons.

Thus, in an embodiment of the method invention, the process is as follows. A heating oil dealer may deliver to a particular customer oil in quantities of more than 25 gallons, typically 100-200 gallons, during the season of high daily consumption, such as during the winter time using a placarded tank truck of more than 1,000 gallons capacity, typically 2,800 to 5,000 gallons, maybe having a gross vehicle weight of more than 26,001 pounds. When a tank truck carries 1,000 gallons more of heating oil, the oil will weigh more than 7,000 pounds and the tank truck with the oil will weigh very much more than 10,000 pounds.

And the same heating oil dealer will deliver at another time to the same particular customer oil in quantities in the range 1 to 5 to 25 gallons, up to about 119 gallons. Such a second delivery may be made when it is appropriate, for example, during the season of low daily consumption, or when the customer is short on money for heating oil, or in the event of emergency need because of the customer running out of heating oil, or when there are adverse road conditions for the dealer's ordinary large local heating oil delivery tank trucks. When the second delivery is made, the dealer will use the portable skid-mounted apparatus of the present invention, as described herein, in combination with a truck or equivalent vehicle. The gross vehicle weight of the vehicle carrying the apparatus with heating oil in the apparatus tank is less than 26,001 pounds. The vehicle used for the second delivery is driven without placards along public roads by a non-CDL qualified driver or by a CDL driver lacking one or more of the required heating oil tank truck related endorsements. The second delivery is made in a way which complies with motor vehicle, transport, environmental and tax laws. The truck will carry less than 119 gallons of home heating oil and the weight of such oil will be no more than about 880 pounds (based on the oil weighing 7.4 pounds per gallon).

In use of apparatus 20 when mounted on a small truck or the like to deliver oil to the customer storage tank or other container, the delivery man will drive to the customer's location and to proximity of the customer heating oil storage tank. With reference again to FIGS. 1 to 4, the delivery man will open the heating oil tank shut-off valve 54 of apparatus 20; actuate a master power switch on the electric panel 64 to provide electric power to the pump motor 27 and to any hose reel driver (and to the meter subsystem if such should be electronic); insert a blank heating oil delivery ticket receipt into the display and ticket printer 40 of meter subsystem 28; input to the preset volume control valve portion of meter subsystem the desired gallon quantity of heating oil to be delivered, if a predetermined quantity is to be delivered; actuate the flow valve lever (not shown) of the meter subsystem; remove the nozzle-valve 30 of the hose 48 from its resting place at drip pan 50 and carry it to the fill pipe or opening of the customer tank or container 32. Hose 48 is pulled as needed from the reel 46. Then, the heating oil delivery valve 30 at the hose nozzle is opened. When discharge of the predetermined heating oil quantity is reached, meter subsystem 28 will automatically stop the flow of heating oil based on the predetermined quantity which the delivery man had programmed into the system. Alternatively, valve 30 is closed by the delivery man to cease flow based on the amount in the customer's heating oil storage tank or container. The hose with closed valve 30 is then returned to the drip pan 50 (or other resting place) and the hose 48 is retracted onto reel 46 with the aid of the motor (not shown) which powers the reel, or by means of a substitute hand crank. Valve 54 is closed and power to the pump motor and the control system is deactivated. A record of the delivery, namely a ticket receipt printed by the meter subsystem, is given to the customer and or taken back to the dealer's shop. Alternatively, the quantity delivered is electronically recorded or wirelessly transmitted to an electromagnetic or optical storage device.

Home heating oil (HHO) consists of a mixture of petroleum-derived hydrocarbons. During petroleum distillation, HHO condenses at between 250 and 350° C. (482 and 662° F.). No. 2 heating oil produces about 128,000 to 138,000 British thermal units per US gallon when combusted and weighs about 7.2 pounds per U.S. gallon. It has a flash point of about 52° C. (126° F.). Its viscosity is in the range 2.5 to 7 centistokes at room temperature. HHO is by U.S. law dyed red to enable persons enforcing motor vehicle fuel tax laws to detect illicit use in over-the-road motor vehicles. Tank trucks having more than 119 gallons capacity and transporting HHO must display a specified federal-mandate placard bearing the number NA 1993.

HHO, which should meet ASTM standard D396, is distinct from diesel fuel which is used in internal combustion engines of motor vehicles. Compared to HHO, diesel fuel typically has certain more particular trace element compositional limits, for instance for sulfur, and it has additives, to tailor it for its internal combustion and fuel injection pump purposes. Diesel fuel is subject to SAE International standards such as J313. Diesel fuel, which is not dyed, is most often distributed and sold to the public through channels of commerce which include automotive and truck filling stations where stationary pumping and metering systems are used. Biodiesel is a fuel oil derived from vegetable and animal fats, and it may comprise a portion of HHO within the ASTM D396 standard. The parts of apparatus 20 which contact HHO, particularly seals and hose parts are accordingly constructed of specialized materials which accommodate hydrocarbons without degradation. On the other hand the metal parts which are in contact with HHO may be mild steel, as mentioned above, in view of the general lubricious and corrosion-protective nature of HHO.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A method for delivering home heating oil to one or more residential or commercial heating oil storage tanks at delivery points of a multiplicity of customers within a fuel oil dealer customer group, comprising:

(a) providing an assembly for dispensing oil configured as an integral unit; the assembly having a length, a first end, a second end, and a weight of no more than 1,500 pounds when fully loaded with oil; the assembly comprising:

A heating oil tank provided with a filler port or hatch, the tank located at the second end and having a capacity of about 119 gallons when fully loaded;

An air and vapor eliminator pipeline in fluid communication with said filler port or hatch;

A pump powered by electricity connected to the tank and positioned between said tank and the first end; said pump capable of flowing heating oil as slow as 2 gallons per minute and as fast as 29 gallons per minute;

At least one battery electrically connected to the electric powered pump, configured to provide power to said pump;

A meter subsystem mounted near the first end, in fluid communication with the pump;

A preset quantity control valve wherein a preset volume of dispensation can be selected and controlled such that the assembly can dispense oil within 0.3% acceptance tolerance, in fluid communication with the meter subsystem;

A hose reel mounted on stanchions, located near the first end and spaced apart lengthwise from the tank, the hose reel configured for unreeling hose by rotating about a horizontal axis, A hose wound around the hose reel and in fluid communication with said preset quantity control valve, A skid, configured for alternative placement as (i) a removably carried article in the bed of a truck, or as (ii) a stationary article setting on a ground surface; wherein said heating oil tank, said pump, said at least one battery, said meter subsystem, said preset quantity control valve, and said hose reel are mounted directly or indirectly on the skid;

(b) providing a truck having a truck bed, a cab, and a gross vehicle weight of 10,000 pounds or less;

(c) loading, securing, and carrying the assembly in said bed of said truck;

Wherein the tank is fully loaded with heating oil;

Wherein the assembly is oriented so that the second end is closer to said cab than said first end;

Wherein the assembly with the tank fully loaded with heating oil weighs no more than 1,500 pounds;

Wherein said truck carrying said assembly can deliver said heating oil to said multiplicity of customers; and Wherein said assembly can be removed from said truck bed and placed on the ground and dispense heating oil while on the ground.

2. The method of claim 1 wherein the assembly is NTEP certified and the assembly delivers heating oil in a weights and measures approved fashion.

3. The method of claim 1 wherein said assembly comprises a plurality of D rings connected to said skid, and wherein step (b) further comprises: connecting said D rings to the bed of said truck by means of a plurality of tie down running from the D rings to said bed.

4. The method of claim 1 wherein said assembly further comprises a printer configured to provide a hard copy of a delivery receipt.

* * * * *